US012161279B2

(12) United States Patent
Ko et al.

(10) Patent No.: US 12,161,279 B2
(45) Date of Patent: Dec. 10, 2024

(54) DISHWASHER

(71) Applicant: LG Electronics Inc., Seoul (KR)

(72) Inventors: Myungwon Ko, Seoul (KR); Yong Jin Choi, Seoul (KR); Dong Hwi Park, Seoul (KR)

(73) Assignee: LG Electronics Inc., Seoul (KR)

( * ) Notice: Subject to any disclaimer, the term of this patent is extended or adjusted under 35 U.S.C. 154(b) by 113 days.

(21) Appl. No.: 17/979,293

(22) Filed: Nov. 2, 2022

(65) Prior Publication Data

US 2023/0138170 A1 May 4, 2023

(30) Foreign Application Priority Data

Nov. 2, 2021 (KR) ..... 10-2021-0149161

(51) Int. Cl.
*A47L 15/50* (2006.01)

(52) U.S. Cl.
CPC ..... *A47L 15/503* (2013.01); *A47L 15/502* (2013.01); *A47L 15/505* (2013.01)

(58) Field of Classification Search
CPC ..... A47L 15/50; A47L 15/502; A47L 15/503; A47L 15/505
See application file for complete search history.

(56) References Cited

U.S. PATENT DOCUMENTS 9,265,404 B2 2/2016 Kaczmarek et al.
11,642,002 B1 * 5/2023 Tanpure ..... A47L 15/503 211/41.8
2003/0089672 A1 * 5/2003 VanLandingham ... A47L 15/503 211/41.9
2006/0108298 A1 * 5/2006 Kim ..... A47L 15/503 211/41.9
2008/0272073 A1 11/2008 Pike et al.
2008/0302740 A1 * 12/2008 Moser ..... A47L 15/503 211/41.8
2012/0056519 A1 * 3/2012 Woo ..... A47L 15/503 312/228.1
2012/0292270 A1 11/2012 Klump et al.
2014/0174486 A1 6/2014 Kaczmarek et al.
2020/0329947 A1 * 10/2020 Clerkin ..... A47L 15/4278
2021/0393108 A1 * 12/2021 Harr ..... A47L 15/503

FOREIGN PATENT DOCUMENTS

CN 203709976 U 7/2014
EP 3539442 A1 9/2019
KR 20060100607 A * 9/2006
WO WO2006015932 A1 2/2006

OTHER PUBLICATIONS

European Search Report in European Appln. No. 22204610.4, mailed on Mar. 15, 2023, 9 pages.

* cited by examiner

*Primary Examiner* — Kimberley S Wright
(74) *Attorney, Agent, or Firm* — Fish & Richardson P.C.

(57) ABSTRACT

A dishwasher includes a storage part in which a washing target is stored. The storage part includes a base formed by crossing a plurality of horizontal bars and a plurality of vertical bars, a supporter portion coupled to the base and having a hollow formed therein, and a holder portion secured to the supporter portion and configured to be rotatable with respect to the supporter portion. The holder portion is configured to maintain a posture set with respect to the supporter portion by pressurizing the supporter portion.

17 Claims, 14 Drawing Sheets

DISHWASHER

CROSS-REFERENCE TO RELATED APPLICATION

This application claims priority to and benefit of Korean Patent Application No. 10-2021-0149161, filed on Nov. 2, 2021, which is hereby incorporated by reference as if fully set forth herein.

BACKGROUND

Technical Field

The present disclosure relates to a dishwasher, more particularly, a dishwasher including a storage part.

Background of the Disclosure

Description disclosed in the background only provides background information on the present disclosure and may not constitute the prior art.

In general, a dishwasher is an electric appliance that washes and dries stored dishes by spraying wash water at a high pressure to the stored dishes. Specifically, in such a dishwasher, wash water is sprayed into a tub, in which dishes are stored, at a high pressure and the sprayed wash water comes into contact with the dishes to wash off contaminations such as food scraps remaining on surfaces of the dishes.

The dishwasher may recycle the used wash water by filtering food residues contained in the wash water through a filter, and it may smoothly separate food residues from the wash water by dissolving and supplying a washing detergent to the wash water. Also, in recent, there has been widely used a dishwasher that increasing the temperature of the wash water by using a heater or generating steam to increase washing efficiency.

The dishwasher includes a tub as a washing space and a storage part releasably provided with respect to the washing tub and configured to selectively accommodate dishes depending on types and sizes.

In this instance, the storage part may be provided in plural and each storage part may be disposed along a vertical direction of the washing tub in multiple steps.

Related art is disclosed in U.S. Pat. No. 9,265,404B2.

The storage part may accommodate dishes and cooking utensils with various sizes and various weights in a relatively narrow space. Accordingly, there is a need for a storage part having a structure capable of increasing space utilization and enhancing user convenience at the same time.

SUMMARY

One objective of the present disclosure is to provide a storage part configured to enhance space utilization and user convenience and a dishwasher including the same.

A further object of the present disclosure is to provide a storage part configured to store various dishes having various shapes in various postures, and a dishwasher including the same.

A still further object of the present disclosure is to provide a storage part configured to give no inconvenience to a user when rotating and securing a rotary tine provided therein to a preset position, and a dishwasher including the same.

A still further object of the present disclosure is to provide a storage part configured to suppress deformation or damage caused when a rotary member, in which a rotary tine is formed, bends under load, and a dishwasher including the same.

Aspects according to the present disclosure are not limited to the above ones, and other aspects and advantages that are not mentioned above can be clearly understood from the following description and can be more clearly understood from the embodiments set forth herein.

The storage part may include a base formed by crossing a plurality of horizontal bars and a plurality of vertical bars. The horizontal bars and the vertical bars may be formed in a bar shape and coupled to a frame defining an exterior design of the storage part at an edge area of the storage part, thereby defining a storage space together with the frame.

A supporter portion may be coupled to the base and have a hollow formed therein. The supporter portion may support rotation of the holder portion and protrude from the base.

A holder portion may be secured to the supporter portion and configured to be rotatable with respect to the supporter portion. As a user applies an external force to the holder portion, the holder portion may rotate with respect to the supporter portion.

The supporter portion may be configured to maintain a preset posture with respect to the supporter portion by pressing the supporter portion. Due to this structure, the holder portion may maintain a lying posture or a standing posture in the storage part.

The holder portion may include a rotary member and a rotary tine. The tine is a protruded structure that can be used in storing a dish.

The rotary member may be disposed in the hollow and configured to be rotatable with respect to the supporter portion. The rotary member may be detachably coupled to the supporter portion. The rotary tine protruding from the rotary member in a direction that crosses a longitudinal direction of the supporter portion.

The holder portion may include a first holder having a longitudinal direction arranged in a first direction; and a second holder spaced apart from the first holder and having a longitudinal direction arranged in a second direction that crosses the first direction.

The supporter portion may include a first supporter in which the first holder is disposed, the first supporter having a longitudinal direction arranged in the first direction; and a second supporter in which the second holder is disposed, the second supporter having a longitudinal direction arranged in the second direction.

The first holder may further include a handle protruding from one end of the rotary tine provided one edge area and extending from the rotary tine in a rotation axial direction of the rotary member.

The supporter portion may have an opening through which the rotary member is introduced when the rotary member is coupled to or decoupled from the supporter portion. The holder portion and the supporter portion may be coupled to or decoupled from each other by detachably disposing the rotary member to the supporter portion.

The rotary member may include a pressing protrusion protruding from the rotary member in a direction crossing a longitudinal direction of the rotary member and configured to press an inner surface of the hollow.

The pressing protrusion may include a first protrusion and a second protrusion. The second protrusion may protrude from the rotary member and spaced apart from the first protrusion in a circumferential direction of the rotary member.

The rotary tine may be provided in plural. The plurality of rotary tines may be spaced a preset distance apart from each other in a longitudinal direction of the rotary member. The first protrusion may be provided in plural and each first protrusion may be disposed between each two of the rotary tines. At least one second protrusion may be disposed between each two of the rotary tines.

As the number of the first and second protrusions is increasing more, the rotary tines may maintain the standing posture more firmly. However, if the number of the first and second protrusions is excessive, the user could feel inconvenient.

Accordingly, the number of the first and second protrusions may be selected, appropriately considering the convenient emotion felt by the user and the degree of firmly maintaining the standing posture of the rotary tines.

The supporter portion may include a first support portion, a second support portion and a base support portion. The first support portion may form some area of the hollow and pressed by contact of an inner surface thereof with the first protrusion in a standing state of the rotary tine. The second support portion may form some area of the hollow and being pressed by contact of an inner surface thereof with the second protrusion in the standing state of the rotary tine.

The base support portion may have both ends connected to the first support portion and the second support portion, respectively. The base support portion may be formed in a lower area of the rotary member to support the rotary member.

Both ends of the rotary member may be rotatably coupled to the supporter portion. If the rotary tines receive load by the rotary tines under this structure, the rotary member might be bent. Accordingly The supporter portion may further include a supporting protrusion protruding from an upper surface of the first support portion and configured to reduce a contact area between a dish stored on the supporter portion and the first support portion.

The first protrusion may include a first curved portion and a second curved portion. The first curved portion may be formed in one side and have a radius that gently increases in a circumferential direction of the rotary member. The second curbed portion may be formed in the other side and have a radius that rapidly increases in the circumferential surface of the rotary member. At this time, the curvature of the second curved portion may be greater than the curvature of the first curved portion.

The second protrusion may include a plane portion formed in one end thereof and configured to maintain a standing state, in which the rotary tines are disposed in a longitudinal direction to cross a lateral direction of the storage part, by pressing an inner surface of the hollow.

The first protrusion and the second protrusion may press the supporter portion, in a standing state in which the rotary tine is disposed in a longitudinal direction to cross a lateral direction of the storage part, and release the pressing with respect to the supporter portion in a lying state in which the rotary tine is disposed in the longitudinal direction to be parallel with the lateral direction of the storage part.

In a lying state in which the rotary tines are disposed in a longitudinal direction parallel with a lateral direction of the storage part, the first protrusion and the second protrusion may release the pressing applied by the first and second protrusions to the support portion.

The rotary tine may include a first rotary tine and a second rotary tine. The first rotary tine may be provided in plural and the plurality of first rotary tines may be spaced a preset distance apart from each other in a longitudinal direction of the holder portion. The second rotary tine may be provided in plural and the plurality of second rotary tines may be a plurality of second rotary tines spaced a preset distance apart from each other in the longitudinal direction of the holder portion and alternately arranged with the plurality of first rotary tines. At this time, the length of the first rotary tine may be greater than that of the second rotary tine.

A dishwasher according to an embodiment of the present disclosure may include a storage part in which a washing target is stored. The storage part may include a base formed by crossing a plurality of horizontal bars and a plurality of vertical bars; a supporter portion coupled to the base and having a hollow formed therein; and a holder portion secured to the supporter portion and configured to be rotatable with respect to the supporter portion, and the holder portion may be configured to maintain a posture set with respect to the supporter portion by pressurizing the supporter portion.

In the dishwasher according to the present disclosure, dishes may be stored in the storage part at various postures facilitated by the holder portion. Accordingly, the user can place or store dishes in the storage part based on the structure and size of each dish and positions of foreign substances on each dish, thereby using the storage part more conveniently. Also, due to this structure, space utilization of the storage part may be increased.

In addition, in the dishwasher according to the present disclosure, the user may set the rotary tine in the standing posture or the lying posture of the rotary tines, thereby storing various types of dishes in the storage part at most appropriate postures for washing, considering the size and shape of the dish and the position of foreign substances on the dish.

In addition, in the dishwasher according to the present disclosure, the rotary tines may be provided with the first rotary tines and the second rotary tines that are alternately provided, with different lengths. Accordingly, the tableware such as a kitchen knife that might cause the user's injury may be safely stored in the storage part.

Specific effects are described along with the above-described effects in the section of Detailed Description.

DESCRIPTION OF REFERENCE NUMERALS

DESCRIPTION OF SPECIFIC EMBODIMENTS

Figure 1:
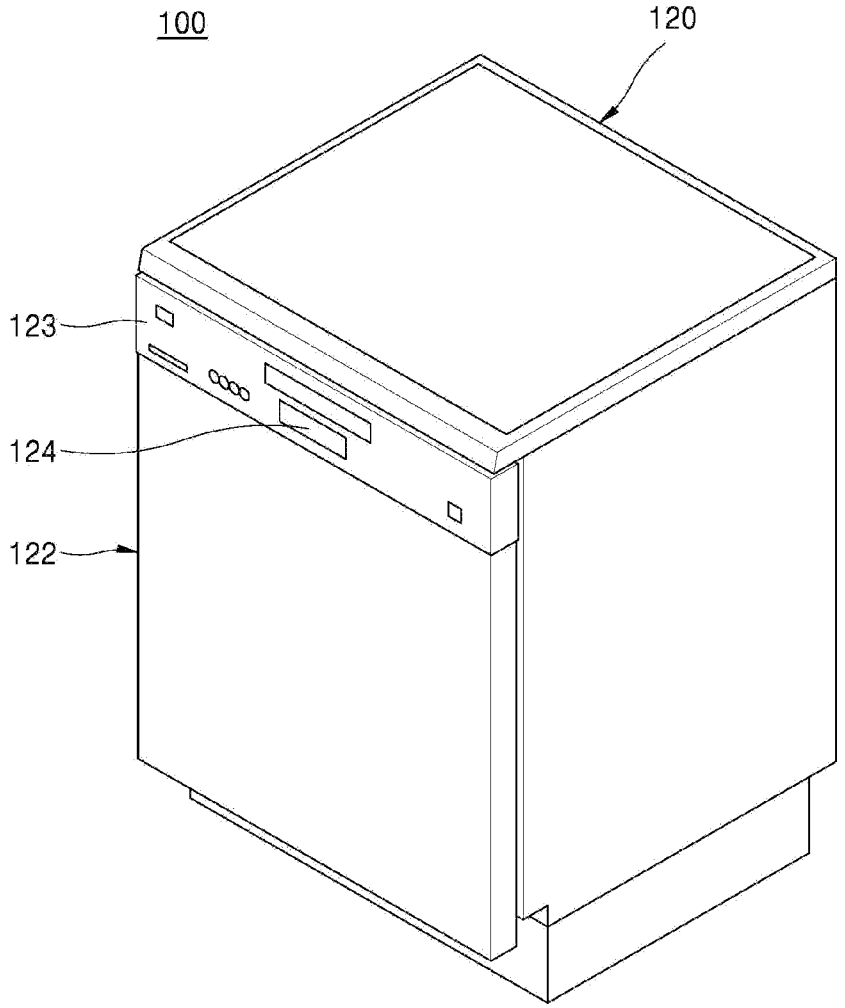
FIG. 1 is a perspective view showing a dishwasher according to an embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Throughout the present disclosure, "up-down direction (or a vertical direction)" means an up-and-down direction of a dishwasher that is installed for daily use. "Left-right direction (or horizontal direction)" means a direction orthogonal to the up-down direction, and "front-back direction means a direction orthogonal to both the up-down direction and the left-right direction. "Both side directions" or "lateral directions" have the same meaning as the left-right direction. These terms may be used interchangeably herein.

Figure 2:
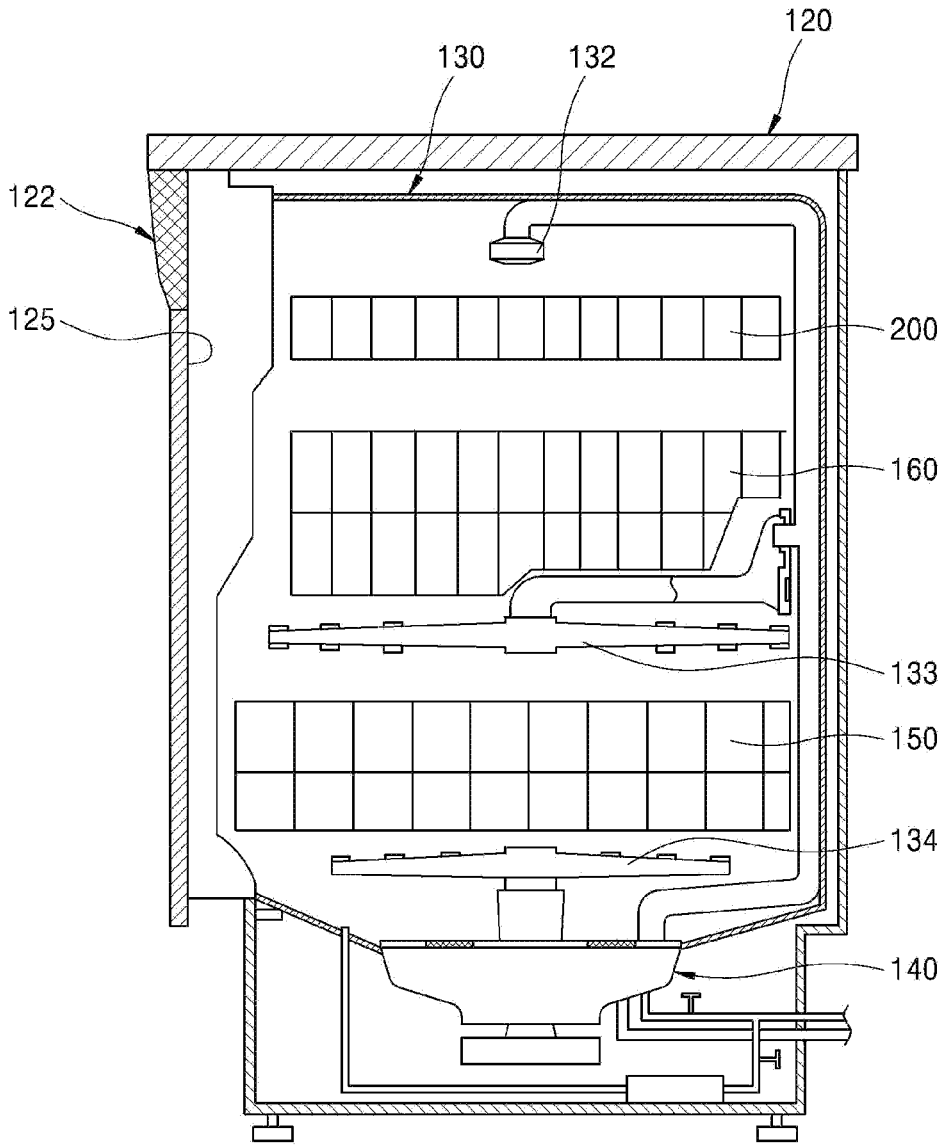
FIG. 2 is a schematically sectional view of a dishwasher according to an embodiment.

FIG. 1 is a perspective view showing a dishwasher 100 according to an embodiment. FIG. 2 is a schematically sectional view of a dishwasher 100 according to an embodiment.

As shown in FIGS. 1 and 2, the dishwasher 100 according to this embodiment may include a case 120 that defines an exterior design of the dishwasher; and a tub 130 provided in the case 120 and defining a washing space to wash washing targets such as dishes, with an open front surface.

In addition, the dishwasher 100 may include a door configured to open and close the open surface of the tub 130; and a drive unit 140 provided below the tub 130 and configured to supply, collect, circulate and discharge wash water for washing the dishes.

The dishwasher 100 may further include a plurality of storage parts 150, 160 and 200 releasably provided within the tub 130 to store washing targets such as dishes, and a plurality of spray parts 132, 133 and 134 disposed adjacent to the storage parts 150, 160 to spray wash water for washing dishes. At this time, the storage parts 150, 160 and 200 may be provided in the dishwasher to store dishes.

Here, the tub 130, the drive part 140 and each spray part among the structures of the dishwasher 100 described above may be implemented by the same or similar structures as those of the prior art, thereby omitting detained description thereof.

Meanwhile, the plurality of storage parts 150, 160 and 200 may be releasably provided inside the tub 130 to be removed through the open surface of the tub 130. The plurality of storage parts 150, 160 and 200 may include a first storage part 150 disposed in a lower region of the tub 130 to accommodate relative large dishes, a second storage part 160 disposed above the first storage part 150 to accommodate relatively small dishes, and a third storage part 200 disposed in an upper region of the tub 130 to accommodate dishes.

The plurality of spray parts 132, 133 and 134 may be configured to spray wash water toward the dishes stored in the storage parts 150, 160 and 200. The plurality of spray parts 132, 133 and 134 may include a lower spray part 134 disposed in a lower region of the tub 130 to spray wash water toward the first storage part 150, an upper spray part 133 disposed between the first storage part 150 and the second storage part 160 to spray wash water toward the first and second storage parts 150 and 160, and a top spray part 132 disposed in an upper region of the tub 130 to spray wash water toward the third storage part 200 or the second storage part 160

However, the top spray part 132 may not be an essential component for configuring the dishwasher 100, and may not be provided depending on embodiments.

Meanwhile, a guide configured to guide the introduction and discharging of the first, second and third storage parts 150, 160 and 200 may be provided in each of lateral walls of the tub 130. A guide mechanism 1310 for guiding the introducing and discharging of the third storage part 200 will be described later in detail, referring to drawings.

A door 122 may be configured to open and close the front of the tub 130 described above. In general, the door 122 may include a hinge portion provided in a lower region of the open surface to open and close the door 122 so that the door can be open with respect to the hinge portion functioning as a rotation axis.

In this instance, a handle 124 for opening the door 122 and a control panel 123 for controlling the dishwasher 100 may be provided on an outer lateral surface of the door 122. An inner lateral surface of the door 122 may form one surface of the tub 130 when the door 122 is close and at the same time form a seating surface on which the first storage part 150 can be seated when the door 122 is opened.

To this end, when the door 122 is opened, the seating surface of the door 122 may form a horizontal plane state extending to the guide through which the first storage part 150 is guided.

Meanwhile, the structure of the storage part and the structure related thereto according to the embodiment will be described below with respect to the third storage part 200. Hereinafter, the structure of the third storage part 200 and the related structure thereto will be described in detail, referring to the accompanying drawing. Hereafter, the third storage part 200 will be referred to as the storage part 200.

Figure 3:
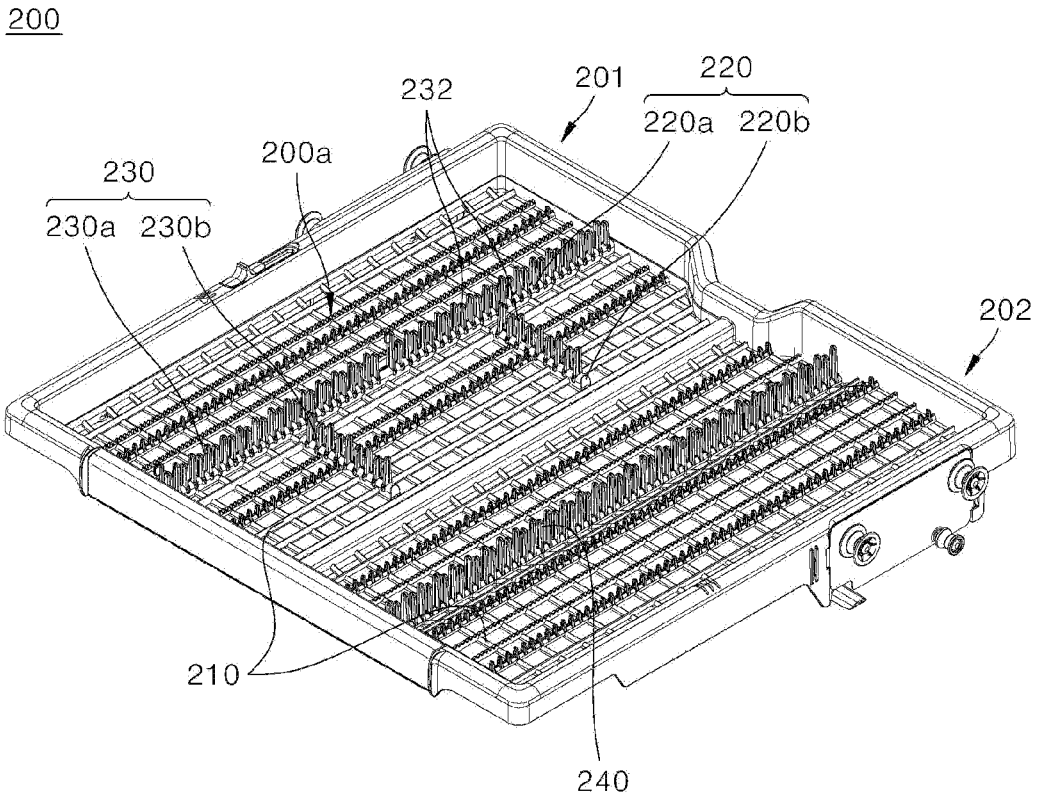
FIG. 3 is a perspective view of a storage part according to an embodiment.

FIG. 3 is a perspective view of the storage part 200 according to an embodiment. The storage part 200 may be configured of a first region 201 and a second region 202. A supporter portion 220 and a holder portion 230 may be disposed in the first region 201. In the supporter portion 220, a rotary tine 232 may be disposed.

The second region 202 may be separable from the first region 201. A fixed tine 240 may be disposed in the second region 202. The rotary tine 232 and the fixed tine 240 may protrude from a bottom o the storage part 200 to hold various types of dishes in the storage part 200.

Accordingly, dishes may be caught on the rotary tine 232 and the fixed tine 240 or the load of the dishes may be supported by the tines to store the dishes. A user can use store various types of dishes in the storage part 200 in various postures by appropriately using the rotary tine 232 and the fixed tine 240.

A tray 200*a* may be provided in the first region 201 and the tray 200*a* may be detachably secured in the storage part 200. In addition, the tray 200*a* may be provided to move up and down with a predetermined range in the storage part 200.

The user can store various types of dishes in the tray by appropriately adjusting the height of the tray 200*a*.

Hereinafter, the detained structure of the present disclosure will be described, referring to the drawings showing that the structure applied to the present disclosure is arranged in the tray 200. However, the structure which will be described below is a structure that can be employed not only in the tray 200*a* of the first region 201 but also in the second region 202.

The storage part 200 may include a base 210, supporter portion and a holder portion 230. The base 210 may be formed in both the tray 200*a* of the first region 201 and the second region 202.

The base 210 may be formed by crossing a plurality of horizontal bars and a plurality of vertical bars. The horizontal bars and the vertical bars may be formed in a bar shape and coupled to a frame at an edge portion of the storage part 200 to define an exterior of the storage part 200.

The supporter portion 220 may be coupled to the base 210 and have a hollow portion 221 formed therein. The holder portion 230 may be secured to the hollow portion 221 and the supporter portion 220 may support the rotation of the holder portion 230. The supporter portion 220 may protrude from the base 210. The supporter portion 220 may be integrally formed with the base, for example, and the present disclosure may not be limited thereto.

The holder portion 230 may be secured to the supporter portion 220 and rotatable with respect to the supporter portion 220. When the user applies an external impact, the holder 230 may be rotated with respect to the supporter portion 220.

The holder portion 230 may be configured to maintain a preset posture with respect to the supporter portion 220 by pressing the supporter portion 220. Due to the structure described above, the holder portion 230 may maintain a lying state or a standing state inside the storage part 200.

Hereinafter, the lying state of the holder portion 230 may mean that a longitudinal direction of the rotary tine 232 provided in the holder portion 230 is disposed parallel to a lateral direction of the storage part 200. The standing state of the holder portion 230 may mean that the longitudinal direction of the rotary tine 232 disposed in cross with the lateral direction of the storage part 200, in other words, side by side with the up-down direction of the storage part 200.

When held on the holder portion 230 at each of the postures (or states), dishes may be stored in the storage part 200 at various postures.

In the embodiment, dishes may be stored in the storage part 200 while taking various postures by the holder portion 230 so that the user can variously place the dishes in the storage part 200 based on the structure and size of the dishes and the locations of the food scraps remaining on the dishes, and can conveniently use the storage part 200. Also, this structure may increase the space utilization of the storage part 200.

Figure 4:
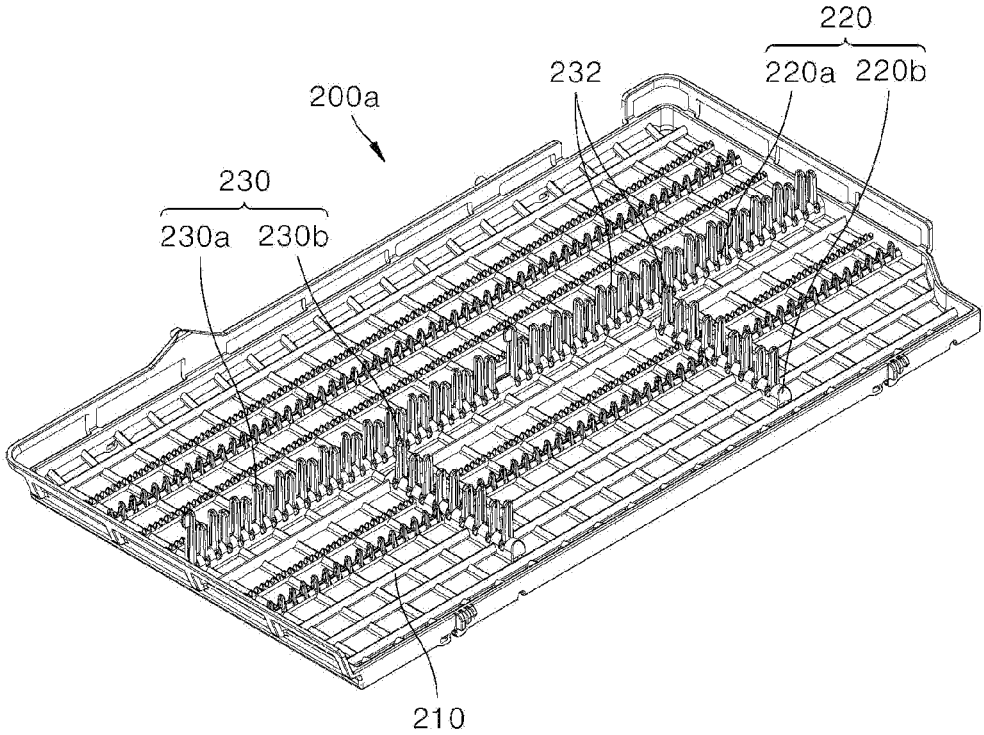
FIG. 4 is a perspective view of a tray according to an embodiment.
Figure 5:
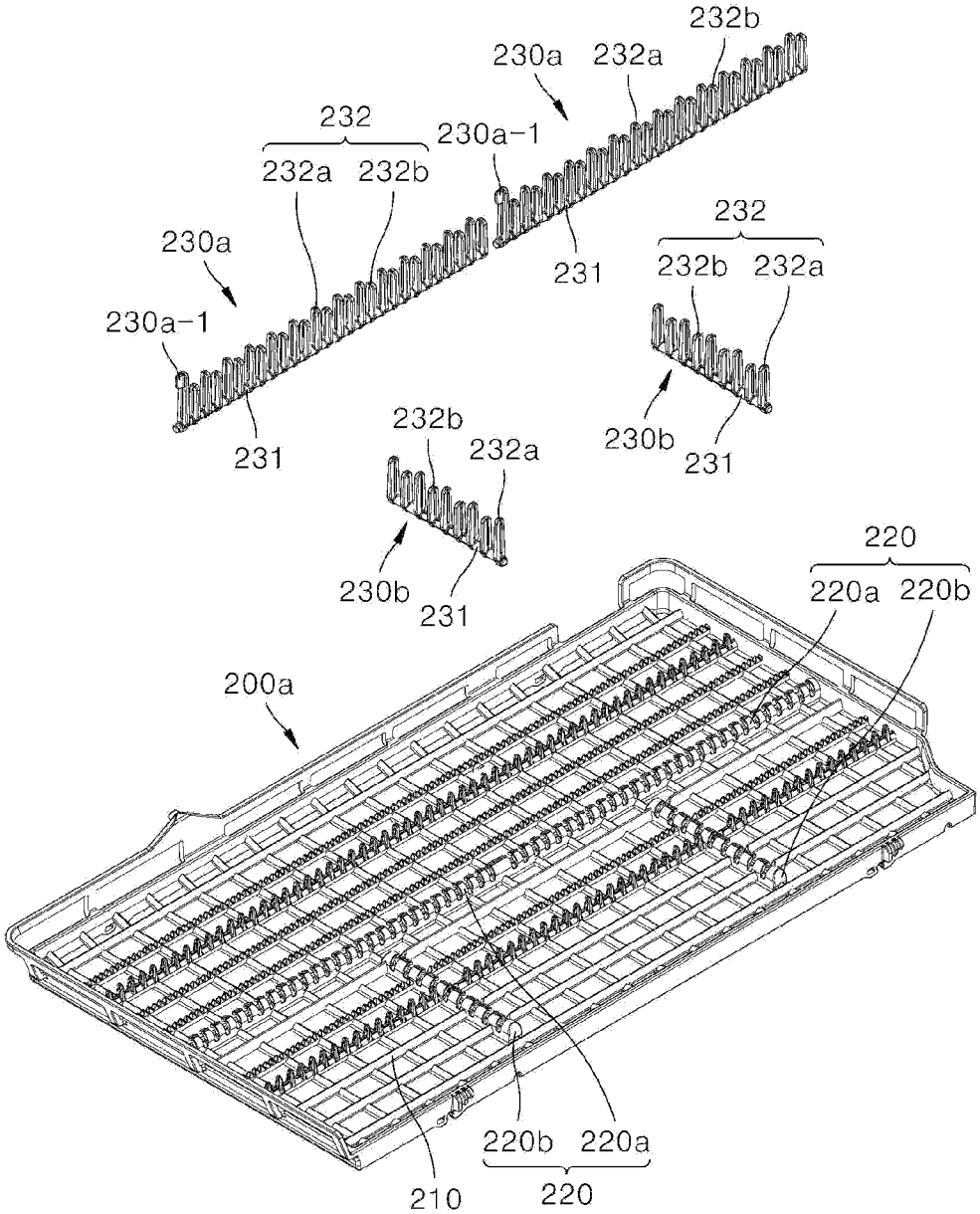
FIG. 5 is an exploded perspective view of a tray according to an embodiment.
Figure 6:
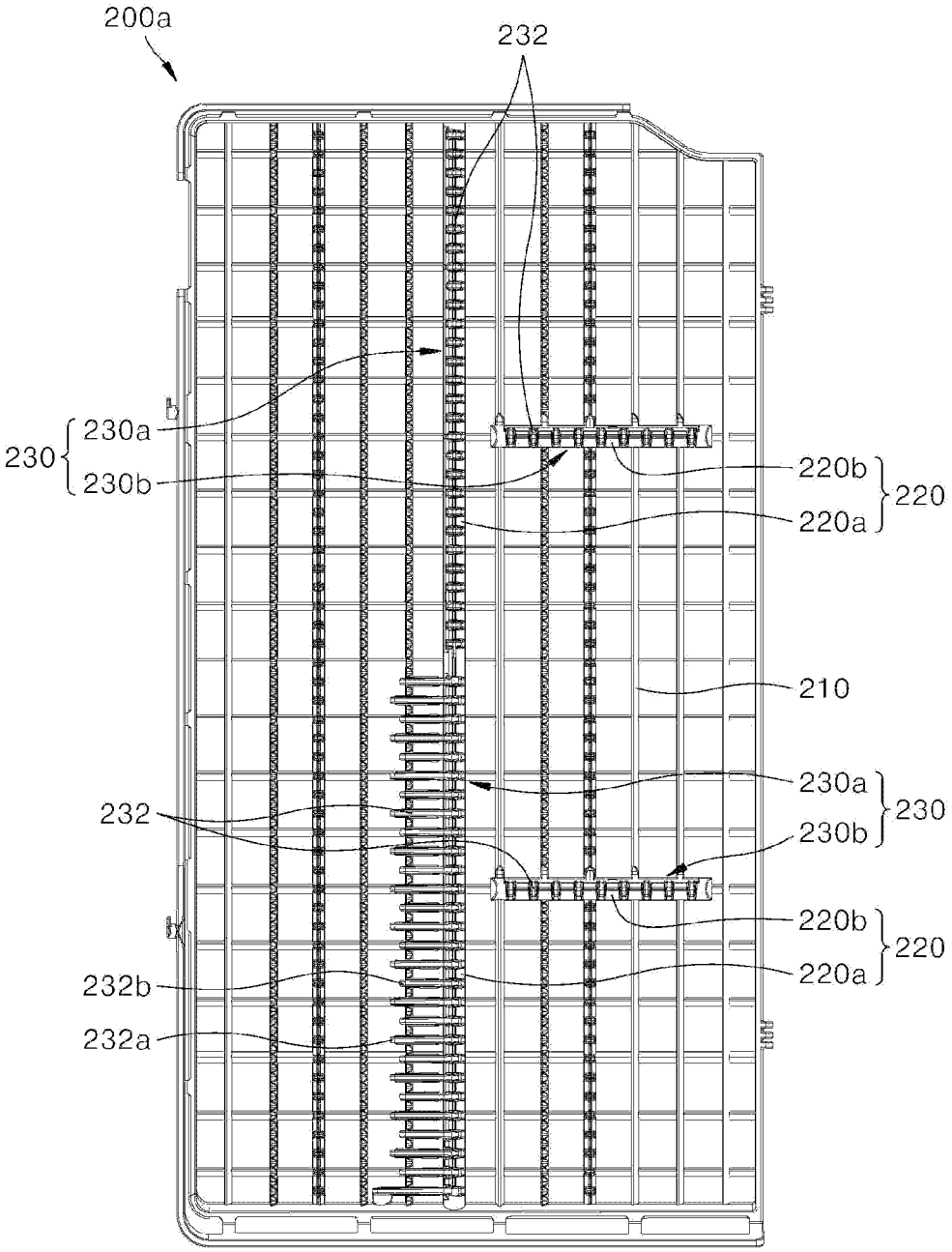
FIG. 6 is a plane view of a tray according to an embodiment.

FIG. 4 is a perspective view of a tray 200*a* according to an embodiment. FIG. 5 is an exploded perspective view of the tray 200*a* according to an embodiment. FIG. 6 is a plane view of the tray 200*a* according to an embodiment.

The holder portion 230 may include a rotary member 231 and a rotary tine 232. Here, the tine may be a protruding structure used to hold dishes.

The rotary member 231 may be disposed in the hollow portion 221 and rotatable with respect to the supporter portion 220. The rotary member 231 may be detachably provided with respect to the supporter portion 220.

The rotary member 231 may have both ends rotatably coupled to the supporter portion 220 to be rotatable with respect to the supporter portion 220 by an external impact. A longitudinal direction of the rotary member 231 may be arranged side by side with a direction of a rotation axis of the rotary member.

The rotary member 231 may protrude in a direction crossing its longitudinal direction. Hereinafter, 'the direction crossing the longitudinal direction' may mean another direction that is not the longitudinal direction. As one example, the angle formed by the longitudinal direction of the rotary member 231 and the protruding direction the rotary tine 232 may be orthogonal or any one of the preliminary or dull angle.

The rotary tine 232 may rotate together with the rotary member 231. The rotary member 231 and the rotary tine 232 may be integrally formed with each other, as one example. The rotary tine 232 may receive and support the dishes to be used in storing the dishes in the storage part 200.

The holder portion 230 may include a first holder 230*a* and a second holder 230*b*. The first holder 230*a* may have a longitudinal direction arranged in a first direction. The second holder 230*b* may be spaced a preset distance apart from the first holder 230*a* and its longitudinal direction may be arranged in a second direction crossing the first direction. At this time, the length of the first holder 230*a* is greater than that of the second holder 230*b*.

The supporter portion 220 may include a first supporter 220*a* and a second supporter 220*b*. The first holder 230*a* may be secured to the first supporter 220*a* and the longitudinal direction of the first supporter 220*a* may be arranged in the first direction. The length of the first supporter 220*a* may be equal to that of the first holder 230*a*.

The second holder 230*b* may be secured to the second supporter 220*b* and the longitudinal direction of the second supporter 220*b* may be arranged in the second direction. The length of the second supporter 220*b* may be equal to that of the second holder 230*b*.

The first holder 230*a* may include a handle 230*a*-1 protruding from one end of the rotary tine 232 provided in an edge and extending from the rotary tine 232 along a rotation axial direction of the rotary member 231.

Since the first holder 230*a* is relatively long, the user could have difficulties in rotating it. Accordingly, the handle 230*a*-1 may be provided at one end of the first holder 230*a* so that the user can conveniently rotate the first holder 230*a* by using the handle 230*a*-1.

As shown in FIGS. 5 and 6, the first holder 230*a* may be provided in plural. The plurality of first holders 230*a* may have the longitudinal directions disposed in the same directions, and may overlap with each other in the longitudinal direction.

The second holder 230*b* may be provided in plural. The plurality of second holders 230*b* may have the longitudinal directions disposed in the same directions, and may be spaced a preset distance apart from each other in a direction crossing the longitudinal direction.

The first holder 230*a* and the second holder 230*b* may be provided in plural, and may be operated separately. Accordingly, some of the first and second holders 230*a* and 230*b* may be used in a standing state of the rotary tine 232, and the others may be used in a lying state of the rotary tine 232.

Corresponding to the plurality of first holders 230*a* and the plurality of second holders 230*b*, a plurality of first supporters 220*a* and a plurality of second supporters 220*b* may be provided. The number of the first supporters 220*a* and second supporters 220*b* may be equal to that of the first holders 230*a* and second holders 230*b*, respectively. The plurality of first and second supporters 220*a* and 220*b* may be disposed in positions and directions corresponding to the plurality of first and second holders 230*a* and 230*b*, respectively.

Figure 7:
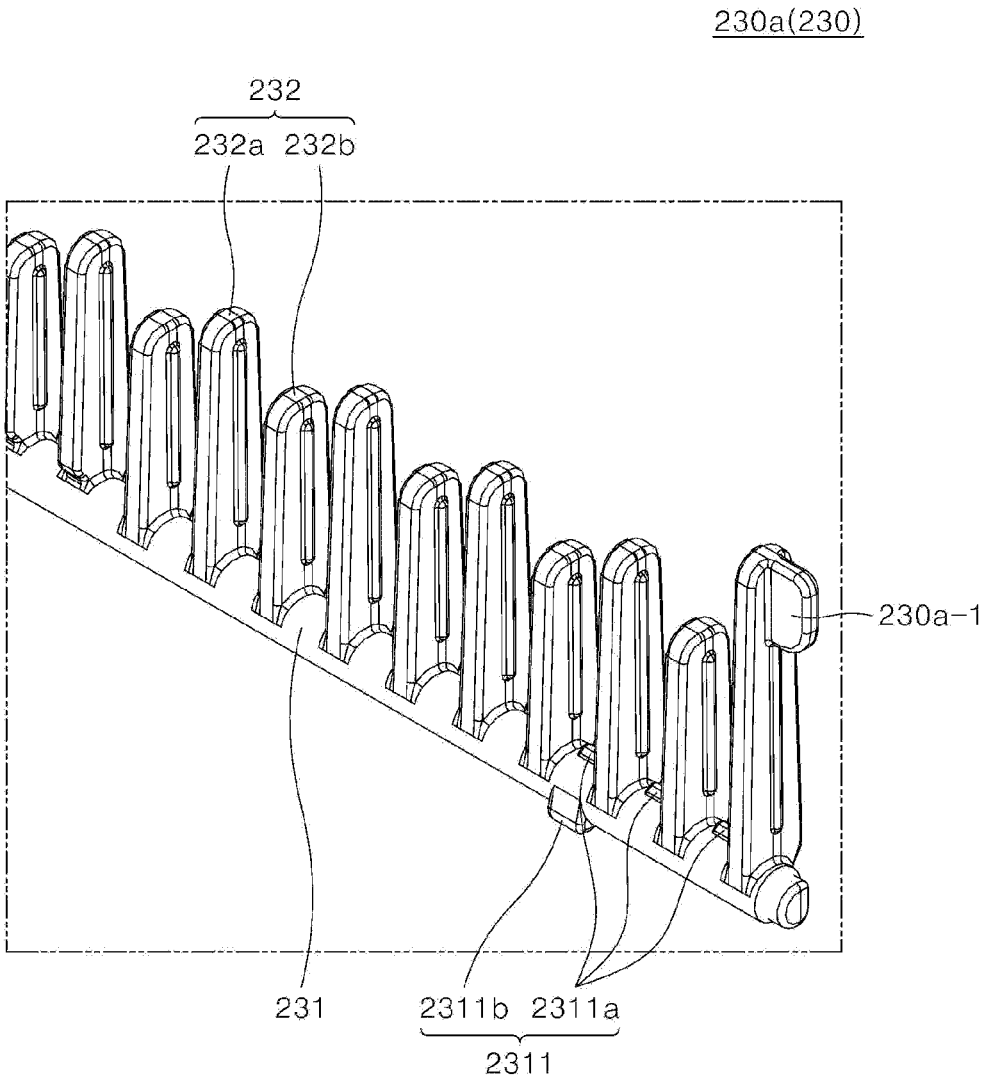
FIG. 7 is a perspective view of a first holder according to an embodiment.
Figure 8:
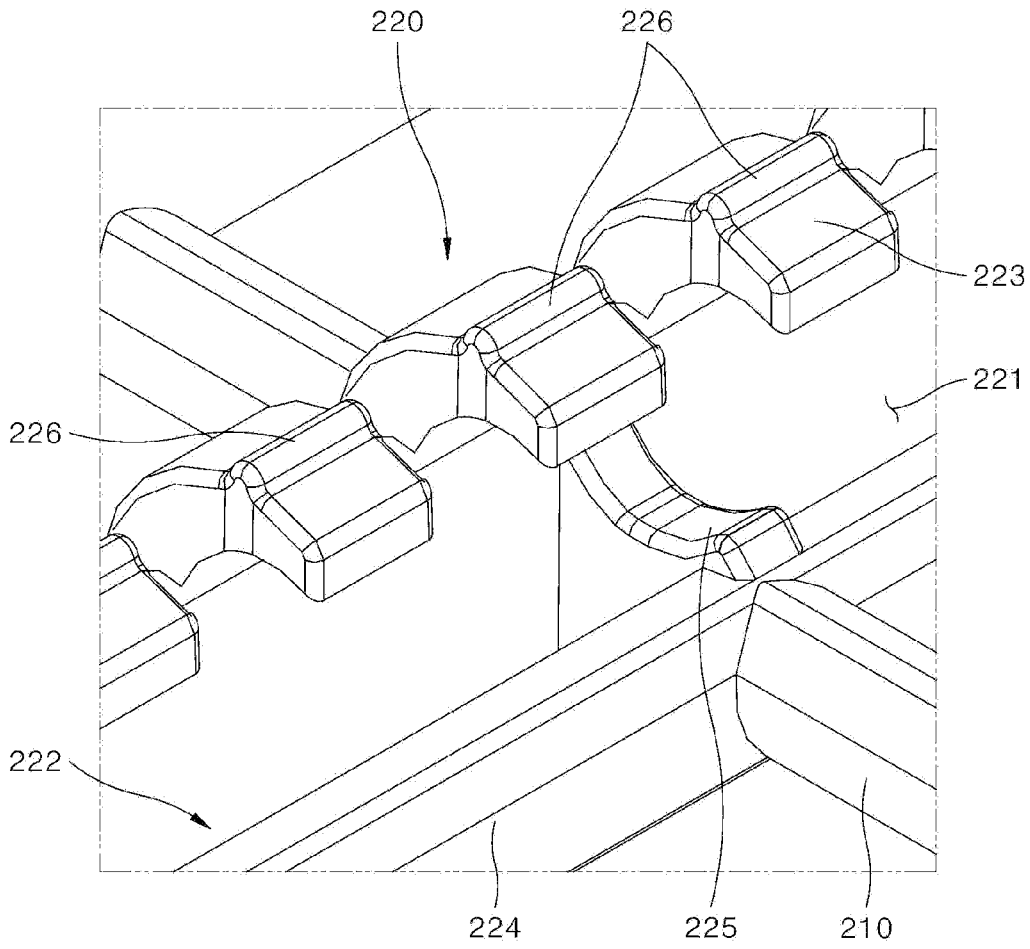
FIG. 8 is an enlarged view showing a supporter portion according to an embodiment.
Figure 9:
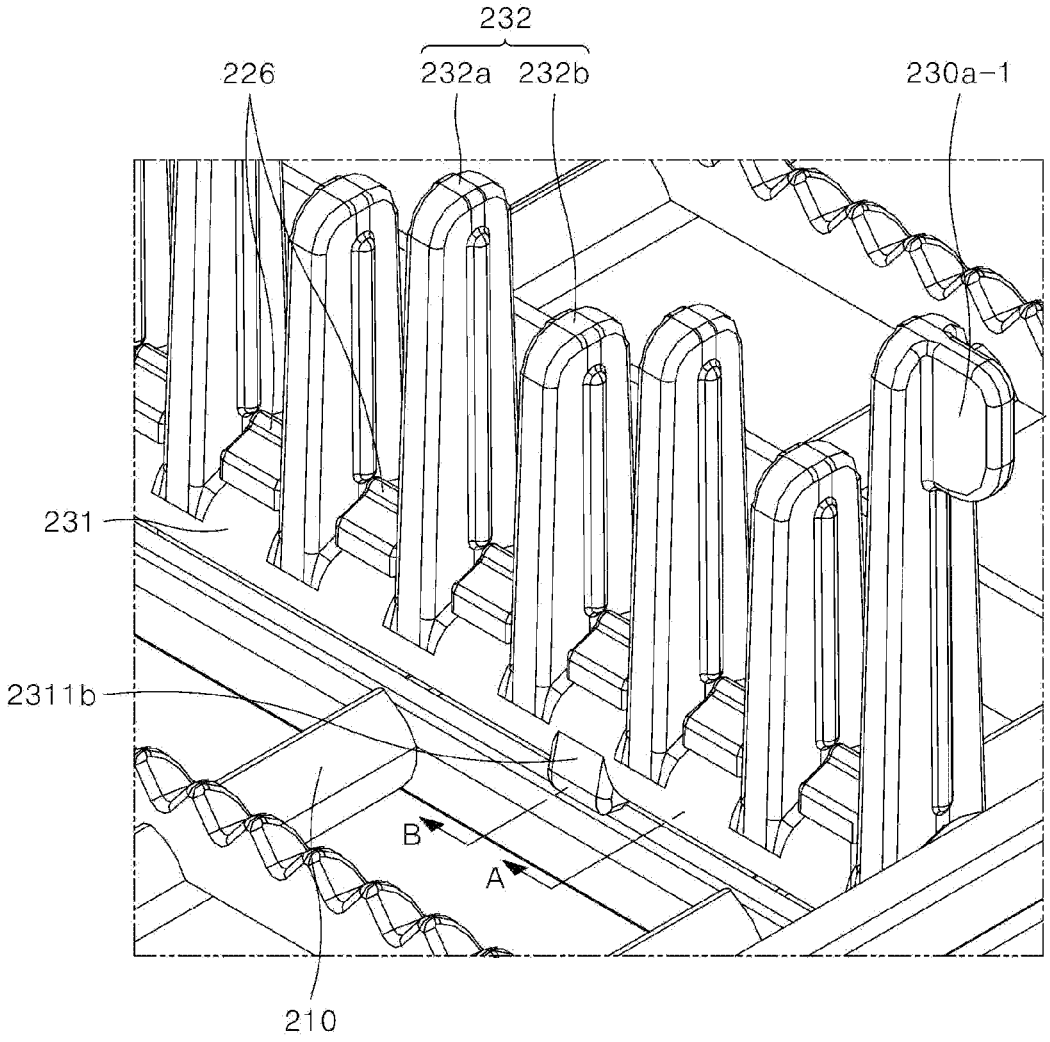
FIG. 9 is an enlarged view showing a state where a first holder is coupled to a supporter portion.

FIG. 7 is a perspective view of a first holder 230*a* according to an embodiment. FIG. 8 is an enlarged view showing a supporter portion 220 according to an embodiment. FIG. 9 is an enlarged view showing a state where the first holder 230*a* is coupled to the supporter portion 220.

The supporter portion 220 may include an opening 222 through which the rotary member 231 enters when the rotary member 231 is coupled to the supporter portion 220 or decoupled there from. As the rotary member 231 is coupled to or decoupled from the supporter portion 220, the holder portion 230 and the supporter portion 220 may be also coupled to or decoupled from each other.

The rotary member 231 may be coupled to the supporter portion 220 after introduced through the opening 222. In a state where the holder portion 230 is secured to the supporter portion 220, the rotary member 231 of the holder portion 230 may be disposed in the hollow of the supporter portion 220.

The rotary member 231 may include a pressing protrusion 2311 protruding in a direction crossing the longitudinal direction of the rotary member 231 to press an inner circumferential surface of the hollow 221.

As the pressing protrusion 2311 presses the inner circumferential surface of the hollow 221, the rotary tine 232 of the holder portion 230 may keep a lying or standing state with respect to the storage part 200.

The pressing protrusion 2311 may include a first protrusion 2311*a* and a second protrusion 2311*b*. The first protrusion 2311*a* may protrude from the rotary member 231. The second protrusion 2311*b* may protrude from the rotary member 231 and be spaced a preset distance apart from the first protrusion 2311*a* in a circumferential direction of the rotary member 231.

Referring to FIG. 7, the rotary tine 232 may be provided in plural. The plurality of rotary tines 232 may be spaced apart from each other in the longitudinal direction of the rotary member 231, and each of the first protrusions 2311*a* may be disposed between each two of the rotary tines 232.

At least one second protrusion 2311*b* may be disposed between each two of the rotary tines 232. It may be appropriate to dispose the second protrusion 2311*b* at a position corresponding to the first protrusion 2311*a* in the rotary member 231.

The magnitude of the pressing force applied to the holder portion 230 by the rotary member 231 may vary based on the number of the first protrusions 2311*a*. As the number of the first protrusions 2311*a* increases, the pressing force applied to the holder portion 230 may increase.

Such the pressing force may be generated by an external force applied to the holder portion 230 by the user in order to change the posture of the holder portion 230. Accordingly, the external force applied by the user may vary based on the number of the first and second protrusions 2311*a* and 2311*b*.

Depending on the magnitude of the force applied by the user to change the posture of the holder portion 230, the user could have a feeling that is convenient or inconvenient when using the storage part 200, for example.

Meanwhile, as the number of the first and second protrusions 2311*a* and 2311*b* increases, the standing posture of the rotary tines 232 may be more firmly maintained. However, if the number of the first and second protrusions 2311*a* and 2311*b* is excessively large, the user might feel inconvenient.

Accordingly, it is preferable to select the number of the first and second protrusions 2311*a* and 2311*b* in appropriate consideration of the user's convenient feeling and the degree to which the rotary tines 232 firmly maintain the standing posture.

Referring to FIG. 8, the supporter portion 220 may include a first support portion 223, a second support portion 224 and a base support portion 225.

The first support portion 223 may form some area of the hollow 221 and have an inner surface that may be pressed in contact with the first protrusion 2311*a*, in the standing state of the rotary tines 232. The second support portion 224 may form some area of the hollow 221 and have an inner surface that may be pressed in contact with the second protrusion 2311*b*, in the standing state of the rotary tines 232.

In the state where the rotary tines 232 are standing, the first protrusion 2311*a* and the second protrusion 2311*b* may press the inner surface of the first support portion 223 and the inner surface of the second support portion 224, respectively, so that the standing state or posture can be firmly maintained even if sprayed wash water or other unintended impacts occur.

The base support portion 225 may have both ends connected to the first support portion and the second support portion 224, respectively, and formed below the rotary member 231 to support it. The base support 225 may configured to close some lower area of the hollow 221.

The both ends of the rotary member 231 may be rotatable coupled to the supporter portion 220. Under the structure, there is a risk that the rotary member 231 is bent, when the rotary tines 232 receive a load from the dishes.

Accordingly, the support portion formed in the lower area of the rotary member 231 may support the load of the rotary member 231 and suppress the escape of the rotary member 231 caused by the bent rotary member 231.

Referring to FIG. 9, the supporter portion 220 may further include a supporting protrusion 226 protruding from an upper surface of the first support portion 223 and configured to reduce a contact area between the dishes held on the supporter portion 220 and the first support portion 223. The supporting protrusion 226 may be provided in the first support portion 223 between neighboring two rotary tines 232.

For example, a small tableware (e.g., a cutlery) may be placed on the first support portion 223 between two rotary tines 232 adjacent to each other. At this time, the supporting protrusion 226 may be formed on the first support portion 223, thereby reducing the contact area between the tableware and the first support portion 223.

Since the contact area is reduced, the wash water may pass smoothly even between the adjacent rotary tines 232. It may be possible to suppress the accumulation of foreign substances such as food waste between the rotary tines 232 and to smoothly wash the stored dishes.

Figure 10:
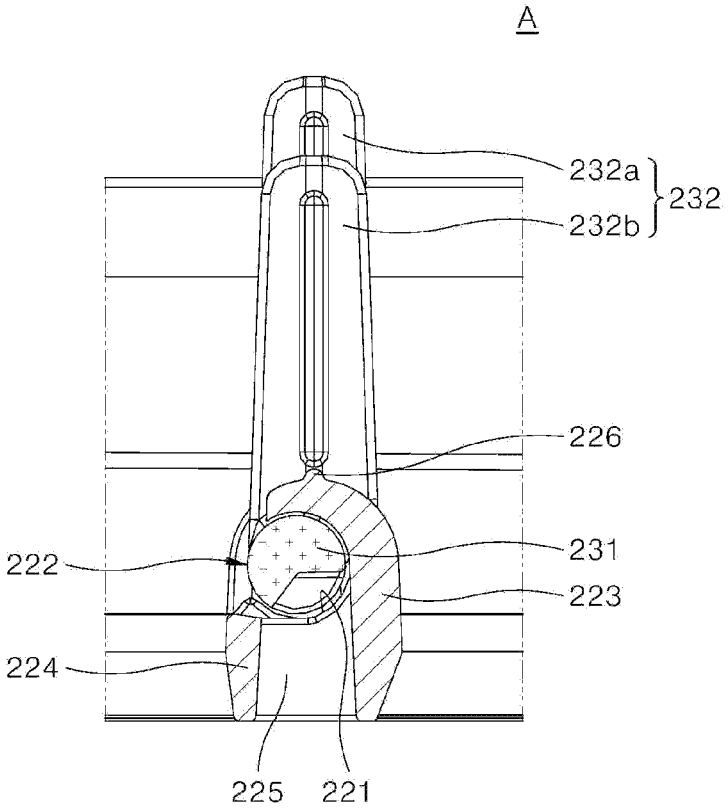
FIG. 10 is a sectional view of 'A' shown in FIG. 9.
Figure 11:
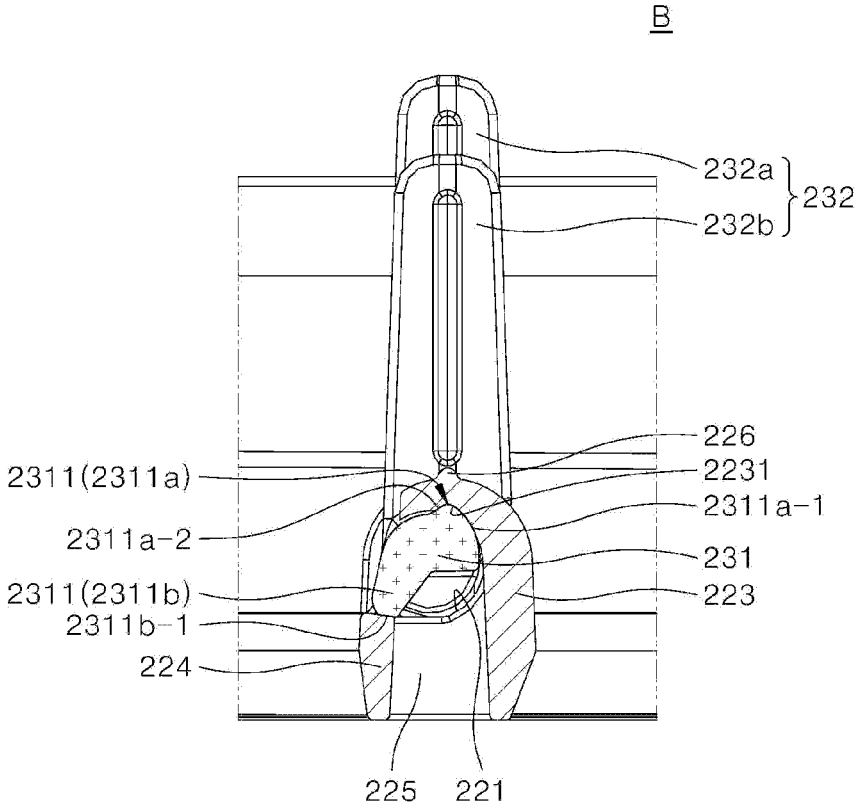
FIG. 11 is a sectional view of 'B' shown in FIG. 9.
Figure 12:
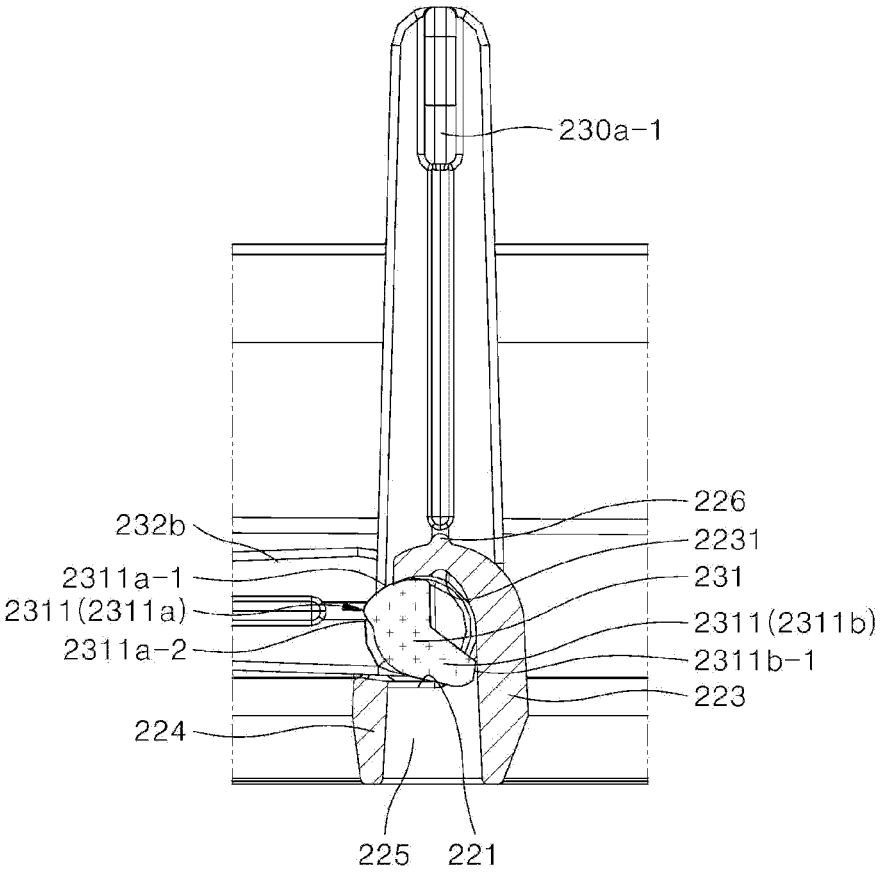
FIG. 12 is a view showing a rotary tine lying after rotating in FIG. 11.

FIG. 10 is a sectional view of 'A' shown in FIG. 9. FIG. 11 is a sectional view of 'B' shown in FIG. 9. FIG. 12 is a view showing a rotary tines 232 lying after rotating in FIG. 11. In FIG. 12, the rotary tines 232 constituting one holder portion 230 are all at lying postures so that a handle of another holder portion disposed at the same position in the longitudinal direction is shown.

When the user changes the lying posture of the rotary tines 232 into the standing posture or vice versa by applying an external force, the holder portion and the supporter portion 220 may be elastically transformed so that the holder portion 230 may rotate with respect to the supporter portion 220 to change the posture.

As shown in FIGS. 11 and 12, a fitting groove 2231 having a shape corresponding to the first protrusion 2311*a* may be formed in the first support portion 223. In the state where the rotary tines 232 are standing, the first protrusion 2311*a* may be fitted in the fitting groove 2231.

The first protrusion 2311*a* may include a first curved portion 2311*a*-1 and a second curved portion 2311*a*-2. The first curved portion 2311*a*-1 may be formed in one side of the first protrusion 2311*a* and have a radius that gently increases in a circumferential direction of the rotary member 231, the second curved portion 2311*a*-2 may be formed in the other side of the first protrusion 2311*a* and have a radius that rapidly increases in the circumferential direction of the rotary member 231, compared to the first curved portion 2311*a*-1.

At this time, the curvature of the second curved portion 2311*a*-2 may be greater than that of the first curved portion 2311*a*-1. The first curved portion 2311*a*-1 and the second curved portion 2311*a*-2 may form a cross-sectional shape of the first protrusion 2311*a*.

Referring to FIGS. 11 and 12, in the standing posture of the rotary tines 232, the first curved portion 2311*a*-1 may be in contact with the inner surface of the hollow 221 in the first support portion 223 in a wide range to press the inner surface.

In FIG. 11, the rotary tines 232 may rotate in a counter-clockwise direction to change the standing posture into the lying posture. To change the standing posture of the rotary tines 232 into the lying posture, the user has to apply an external force that is greater than a preset value.

However, there is a possibility that the rotary tines are changed from the standing state to the lying state by sprayed wash water or other unintended forces. In order to suppress the unintended rotation of the rotary tines 232, the radius of the second curved portion 2311*a*-2 may more rapidly increase in the circumferential direction than the first curved portion 2311*a*-1 so that the rotary tines 232 may line down only by an external force greater than or equal to the preset value.

This structure may suppress the rotary tines 232 from being laid by the unintended force so that the rotary tines may firmly maintain the standing posture.

Referring to FIG. 11, the second curved portion 2311*a*-2 may suppress the rotary tines 232 from lying after rotated in a counter-clockwise direction so that the rotary tines 232 may be in the standing state.

As shown in FIG. 11, the first protrusion 2311*a* and the first curved portion 2311*a*-1 may be in close contact with the inner surface of the first support portion 223. This is because a sectional area of the inner surface of the first support portion 223 has a shape corresponding to shapes of the first protrusion 23111*a* and the first curved portion 23111*a*-1.

At this time, if an unintended force is applied to the rotary tines 232 in a clockwise direction, the first protrusion 2311*a* and the first curved portion 2311*a*-1 may be blocked by the inner surface of the first support portion 223 only to be unable to rotate any more.

Due to this structure, the clockwise-direction rotation of the rotary tines caused by the unintended force may be effectively suppressed, thereby firmly maintaining the standing posture of the rotary tines 232.

The second protrusion 2311*b* may include a plane portion 2311*b*-1 be formed in an end thereof and pressing an inner surface of the hollow 221 to maintain the standing state of the rotary tines 232 in which the rotary tines 232 are disposed along the longitudinal direction to cross the lateral direction of the storage part 200. For example, the plane portion 2311*b*-1 may be formed by providing a chamfered portion at the end of the second protrusion 2311*b*.

The second protrusion 2311*b* may protrude from a surface of the rotary member 231 in a radial direction of the rotary member 231. Accordingly, the length of the second protrusion 2311*b* may be greater than the radius of the rotary member 231. In addition, the plane portion 2311*b*-1 may be formed in the end of the second protrusion 2311*b* so that the plane portion 2311*b*-1 can be located outside the radius range of the rotary member 231.

When the rotary tines 232 stand, an upper surface of the second support portion 224 may become in contact with the plane portion 2311*b*-1 to support the rotary member 231. When the rotary tines 232 lie, the second support portion 224 and the plane portion 2311*b*-1 may be spaced apart from each other not to be in contact.

When the rotary tines 232 are in the standing state, the plane portion 2311*b*-1 may press the inner surface of the hollow 221. Due to the plane portion 2311*b*-1, the second protrusion 2311*b* may contact with the inner surface of the hollow 221 in a relatively wide range. Accordingly, wear caused by contact between the second protrusion 2311*b* and the inner surface of the hollow 221 can be effectively suppressed.

In addition, since the second protrusion 2311*b* can press the inner surface of the hollow 221 in a relatively large range due to the plane portion 2311*b*-1, the standing state of the rotary tines 232 may be firmly maintained.

As shown in FIG. 11, the first protrusion 2311*a* and the second protrusion 2311*b* may press the supporter portion 220 in the standing state in which the rotary tines 232 are disposed in the longitudinal direction to cross the lateral direction of the storage part 200.

In the standing state of the rotary tines 232, the first protrusion 2311*a* may be fitted to a fitting groove 2231 formed in the first support portion 223 of the supporter portion 220 to press the first support portion 223. At this time, the second protrusion 2311*b* may press the second support portion 224 of the supporter portion 220.

Under this structure, as long as the user does not apply an external force again, the standing state of the rotary tines 232 may be firmly maintained. In this instance, the holder portion 230 and the supporter portion 220 are pressurized in contact with each other so that the holder portion 230 will not be shaken by the spraying of wash water or other unintended forces.

Accordingly, the dishes supported by the rotary tines 232 may be washed in a state of being stably stored in the storage part 200. Noise generated by shaking of the rotary tines 232 may be effectively suppressed.

As shown in FIG. 12, the pressurizing of the first protrusion 2311*a* and the second protrusion 2311*b* with respect to the supporter portion 220 may be released in the lying state where the rotary tines 232 are disposed to lie in the longitudinal direction parallel with the lateral direction of the storage part 200.

Even in this instance, the first protrusion 2311*a* and the second protrusion 2311*b* may not pressurize the supporter portion 220, but the rotary member 231 may maintain partial contact with the inner surface of the hollow 221. Accordingly, the holder portion 230 and the supporter portion 220 may maintain the pressurizing state with respect to each other.

Accordingly, the holder portion 230 will not be shaken by the sprayed wash water or other unintended external forces. Due to this structure, the dishes supported by the rotary tines 232 at the lying posture may be stably stored and washed in the storage part 200, and the noise generated by the shaking of the rotary tines 232 may be effectively suppressed.

In the embodiment, the user can store various types of dishes in the storage parts 200 of various types of dishwashers 100 at the more appropriate posture by setting the rotary tines 232 in the standing posture or the lying posture in consideration of the size and the shape of the dish and the location of foreign substances on the dish.

Figure 13:
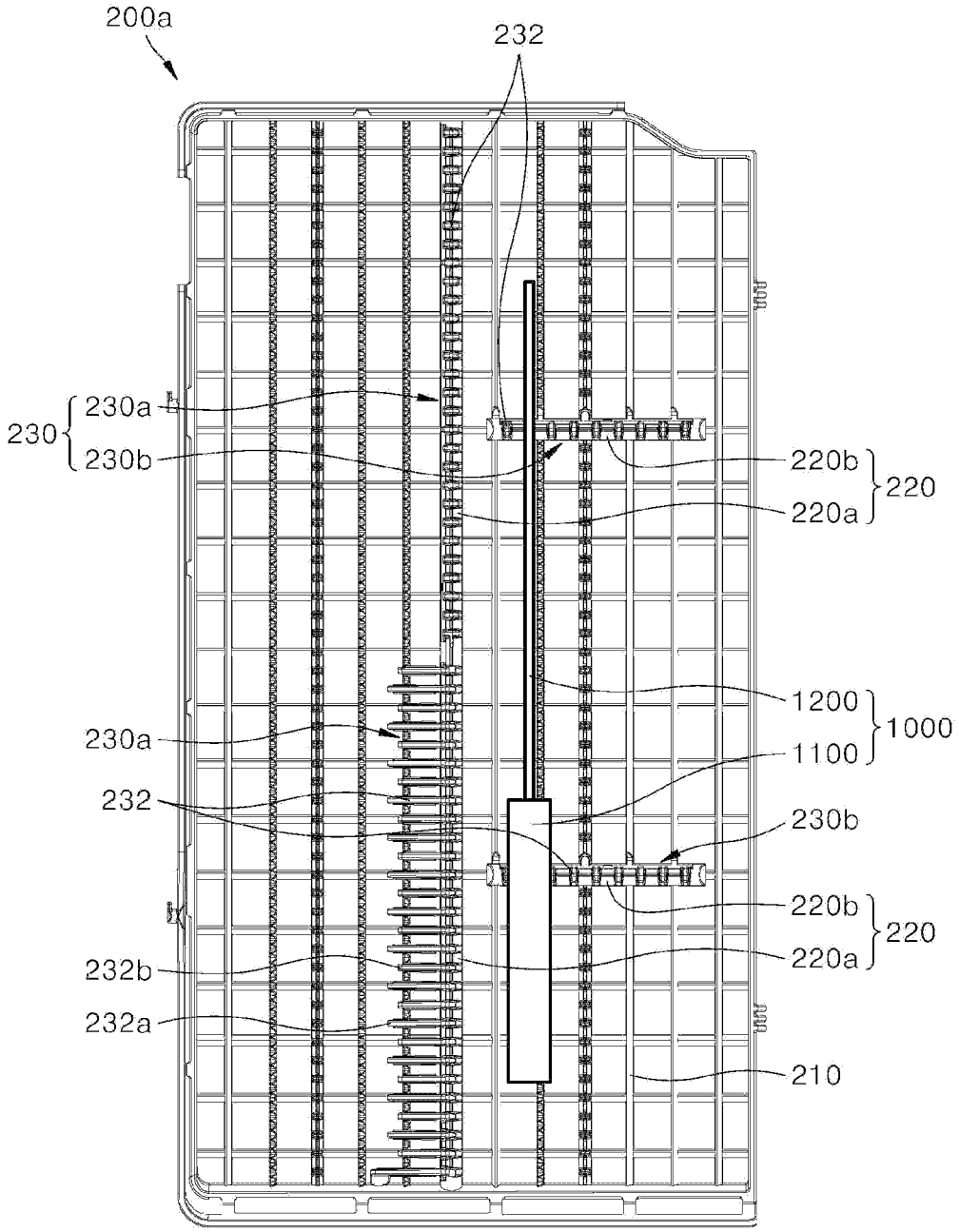
FIG. 13 is a plane view showing a usage state of a tray according to an embodiment.
Figure 14:
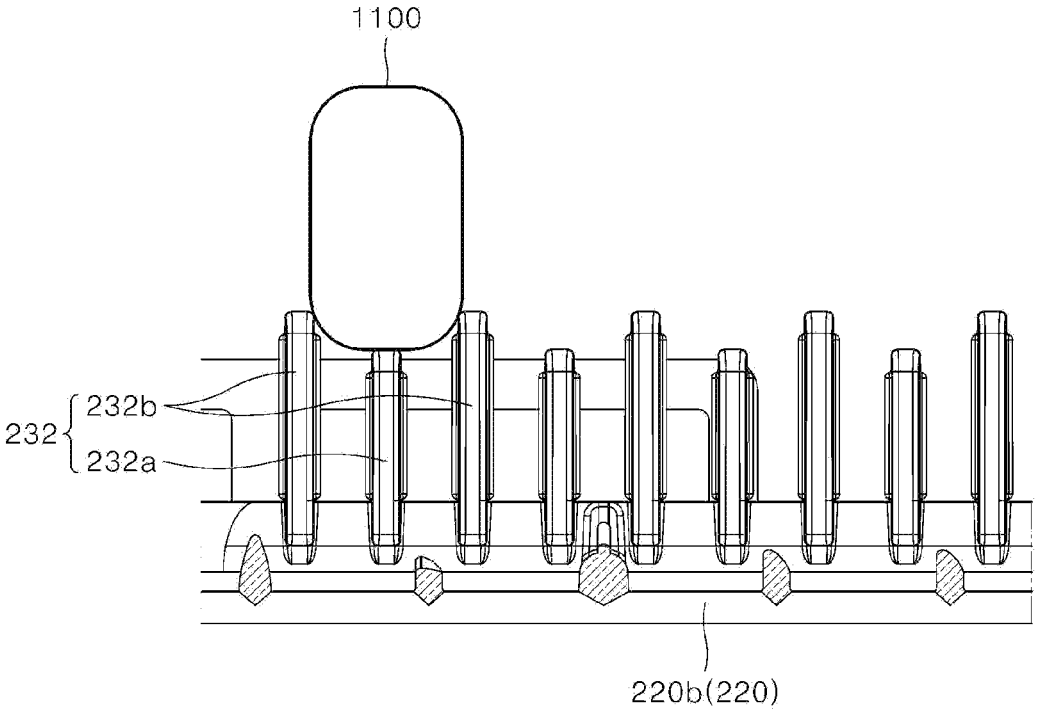
FIG. 14 is a front view showing a usage state of a tray according an embodiment.

FIG. 13 is a plane view showing a usage state of a tray 200*a* according to an embodiment. FIG. 14 is a front view showing a usage state of a tray 200*a* according an embodiment. The rotary tine 232 may include a first rotary tine 232*a* and a second rotary tine 232*b*.

A plurality of first rotary tines 232*a* may be provided and spaced a preset distance apart from each other in a longitudinal direction of the holder portion 230. A plurality of second rotary tines 232*b* may be provided and spaced a preset distance apart from each other in the longitudinal direction of the holder portion 230, while being alternately disposed with the plurality of first rotary tines 232*a*. At this time, the length of the first rotary tine 232*a* may be greater than that of the second rotary tine 232*b*.

Under this structure, each one of the second rotary tines 232*b* may be disposed adjacent to two first rotary tines 232*a*. For example, a kitchen knife 1000 may be stored in the storage part 200. In this instance, the kitchen knife 1000 may have a grip portion 1100 with a thick cross-sectional shape and a blade 1200 with a thin cross-sectional shape.

The grip portion 1100 of the kitchen knife 1000 may be placed on a position where one second rotary tine 232*b* and two adjacent first rotary tines 232*a* are located. Accordingly, a lower area of the grip portion 1100 may be placed on the second rotary tine 232*b*, and lateral surfaces of the lower area may be supported by the two first rotary tines 232*a*. Since the grip portion 1100 is disposed on the rotary tines 232 inside the storage part 200, the kitchen knife 1000 may be stably stored in the storage part 200.

In an embodiment, the rotary tines 232 may include first rotary tines 232*a* and second rotary tines 232*b*, which are alternately disposed with each other with different lengths. Accordingly, tableware that might course injury to the user (e.g., the kitchen knife 1000) may also be safely stored in the storage part 200.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising:

a storage configured to accommodate a washing target, the storage comprising:

a base comprising a plurality of horizontal bars and a plurality of vertical bars that cross the plurality of horizontal bars;

a supporter coupled to the base, the supporter defining a hollow portion therein; and a holder coupled to the supporter and configured to rotate with respect to the supporter, wherein the holder is configured to, based on applying pressure to the supporter, maintain a set posture with respect to the supporter, wherein the holder comprises:

a rotary member disposed in the hollow portion and detachably coupled to the supporter, the rotary member being configured to rotate with respect to the supporter, and a rotary tine that protrudes from the rotary member in a direction crossing a longitudinal direction of the supporter, wherein the rotary member comprises a pressing protrusion that protrudes from the rotary member in a radial direction of the rotary member, the pressing protrusion being configured to press an inner surface of the hollow portion, wherein the pressing protrusion comprises a first protrusion, and wherein the first protrusion comprises:

a first curved portion that is disposed at a first side of the first protrusion and defines a first curvature, and a second curved portion that is disposed at a second side of the first protrusion and defines a second curvature greater than the first curvature.

2. The dishwasher of claim 1, wherein the supporter further defines an opening configured to receive the rotary member based on the rotary member being coupled to or decoupled from the supporter.

3. The dishwasher of claim 1, wherein the pressing protrusion further comprises a second protrusion that is spaced apart from the first protrusion in a circumferential direction of the rotary member.

4. The dishwasher of claim 3, wherein each of the first protrusion and the second protrusion is configured to:

apply the pressure to the supporter based on the rotary tine being in a standing state in which the rotary tine is disposed in a direction crossing a lateral direction of the storage; and release the pressure applied to the supporter based on the rotary tine being in a lying state in which the rotary tine is disposed in a direction parallel to the lateral direction of the storage.

5. The dishwasher of claim 3, wherein the rotary tine is one of a plurality of rotary tines that are arranged at the holder and spaced apart from one another by a preset distance in a longitudinal direction of the rotary member, and wherein the first protrusion is one of a plurality of first protrusions that are disposed at the rotary member, each of the plurality of first protrusions being disposed between two of the plurality of rotary tines.

6. The dishwasher of claim 5, wherein the second protrusion is disposed between two of the plurality of rotary tines.

7. The dishwasher of claim 3, wherein the second protrusion comprises a plane portion disposed at an end of the second protrusion, the plane portion being configured to press the inner surface of the hollow portion to thereby maintain a standing state of the rotary tine in which the rotary tine is disposed in a direction crossing a lateral direction of the storage.

8. The dishwasher of claim 7, wherein a length of the second protrusion is greater than a radius of the rotary member, and wherein the plane portion is located at a position outside the radius of the rotary member.

9. The dishwasher of claim 7, wherein the supporter comprises:

a first support portion that defines a first area of the hollow portion and has an inner surface that is configured to be pressed by and in contact with the first protrusion based on the rotary tine being in the standing state;

a second support portion that defines a second area of the hollow portion and has an inner surface that is configured to be pressed by and in contact with the second protrusion based on the rotary tine being in the standing state; and a base support portion that is disposed below the rotary member and supports the rotary member, the base support portion having a first end connected to the first support portion and a second end connected to the second support portion.

10. The dishwasher of claim 9, wherein an upper surface of the second support portion is configured to contact the plane portion to thereby support the rotary member.

11. The dishwasher of claim 9, wherein the supporter further comprises a supporting protrusion that protrudes from an upper surface of the first support portion and defines a contact area between a dish placed at the supporter and the first support portion.

12. The dishwasher of claim 1, wherein the holder comprises:

a first holder arranged in a first direction; and a second holder spaced apart from the first holder and arranged in a second direction that crosses the first direction.

13. The dishwasher of claim 12, wherein the supporter comprises:

a first supporter that supports the first holder and is arranged in the first direction; and a second supporter that supports the second holder and is arranged in the second direction.

14. The dishwasher of claim 13, wherein the first holder comprises a handle that protrudes from an end of the rotary tine disposed at an edge area of the rotary member, the handle extending from the rotary tine in a rotation axial direction of the rotary member.

15. The dishwasher of claim 1, wherein the rotary tine comprises:

a plurality of first rotary tines spaced apart from one another in a longitudinal direction of the holder; and a plurality of second rotary tines spaced apart from one another and alternately arranged with the plurality of first rotary tines along the longitudinal direction of the holder, and wherein a length of each of the plurality of first rotary tines is greater than a length of each of the plurality of second rotary tines.

16. The dishwasher of claim 15, wherein the holder further comprises a handle that protrudes from one of the plurality of first rotary tines that is disposed at an edge area of the rotary member, the handle extending in a rotation axial direction of the rotary member.

17. The dishwasher of claim 1, further comprising:

a case that defines an external appearance of the dishwasher;

a tub that is disposed inside the case and defines a washing space configured to receive the washing target; and a plurality of storages disposed in the washing space and spaced apart from one another, the plurality of storages including the storage.

* * * * *